US005967642A

United States Patent [19]

Chiu

[11] Patent Number: 5,967,642

[45] Date of Patent: Oct. 19, 1999

[54] FLASHLIGHT

[76] Inventor: Si Fu Chiu, Unit 10, 19th Floor, Technology Plaza, 29-35 Sha Tsui Road, Tsuen Wan, New Territories, The Hong Kong Special Administrative Region of the People's Republic of China

[21] Appl. No.: 08/969,255

[22] Filed: Nov. 13, 1997

[30] Foreign Application Priority Data

Nov. 13, 1996 [GB] United Kingdom ..... 9623607

[51] Int. Cl.[6] ..... F21L 7/00

[52] U.S. Cl. ..... 362/205; 362/202

[58] Field of Search ..... 362/205, 184, 362/202, 187

[56] References Cited

U.S. PATENT DOCUMENTS 4,286,311 8/1981 Maglica .
4,843,526 6/1989 Price, III ..... 362/205
5,331,528 7/1994 Chen .
5,390,091 2/1995 Maglica ..... 362/205
5,426,273 6/1995 Shiau ..... 362/205
5,765,937 6/1998 Shiau ..... 362/205
5,833,354 11/1998 Maglica ..... 362/205

*Primary Examiner*—Sandra O'Shea
*Assistant Examiner*—Todd Reed Hopper
*Attorney, Agent, or Firm*—Jackson Walker L.L.P.

[57] ABSTRACT

A flashlight which comprises a barrel for containing two battery cells, said barrel having opposite ends and an internal detent/recess, head and tail pieces provided at respective barrel ends, a light bulb enclosed by the head piece, and an on/off switch. The switch has a resiliently biassed projecting post and is provided inside the barrel at a position between and for switching on and off electrical connection between the light bulb and the battery cells. The post is arranged to engage automatically with the detent/recess in a snap-fit manner when the switch is moved into the barrel through one barrel end to the aforesaid position, thereby holding the switch in that position.

8 Claims, 1 Drawing Sheet

FLASHLIGHT

The present invention relates to an electric torch or flashlight having an on/off switch that can easily be installed during assembly.

SUMMARY OF THE INVENTION

According to the invention, there is provided a flashlight comprising a barrel for containing a battery cell, said barrel having opposite ends and an internal detent, head and tail pieces provided at respective barrel ends, a light bulb enclosed by the head piece, and an electrical press switch provided inside the barrel at a position between and for switching on and off electrical connection between the light bulb and the battery cell, said switch having an operating member and a projection resiliently biassed apart, said projection being arranged to engage automatically with the barrel detent in a snap-fit manner when the switch is moved into the barrel through one barrel end to the aforesaid position, thereby holding the switch in that position.

Preferably, the switch has a body which has an outer cross-sectional size marginally smaller than the inner cross-sectional size of the barrel, and the projection projects slightly out of the outer cross-section of the switch body.

It is preferred that the projection is elongate and is resiliently biassed longitudinally outwards by a spring.

Preferably, the barrel detent is in the form of a hole or recess.

It is preferred that the operating member and the projection are resiliently biassed apart by a common spring.

In a preferred embodiment, the switch has two terminals on opposite sides for electrical connection, through physical contact with or without a conductive spring, with the light bulb and the battery cell, respectively.

In a specific construction, the switch has two fixed contacts for electrical connection with the light bulb and the battery cell, respectively, and includes a moving contact movable into or out of electrical contact with the fixed contacts.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1:
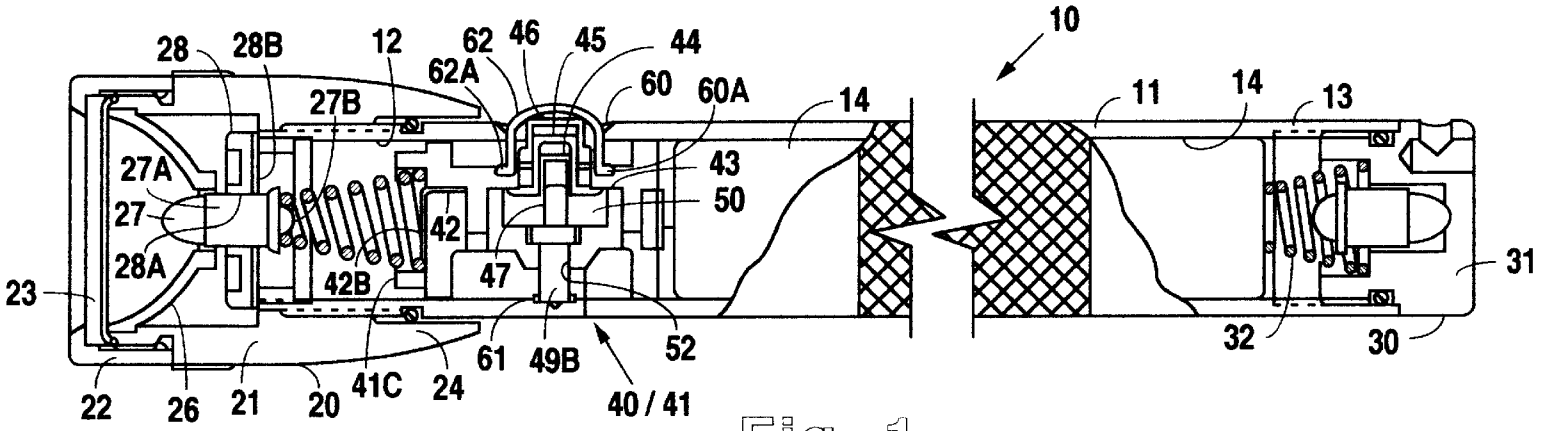
FIG. 1 is a cross-sectional side view of an embodiment of a flashlight, having an on/off switch, in accordance with the invention.
Figure 2:
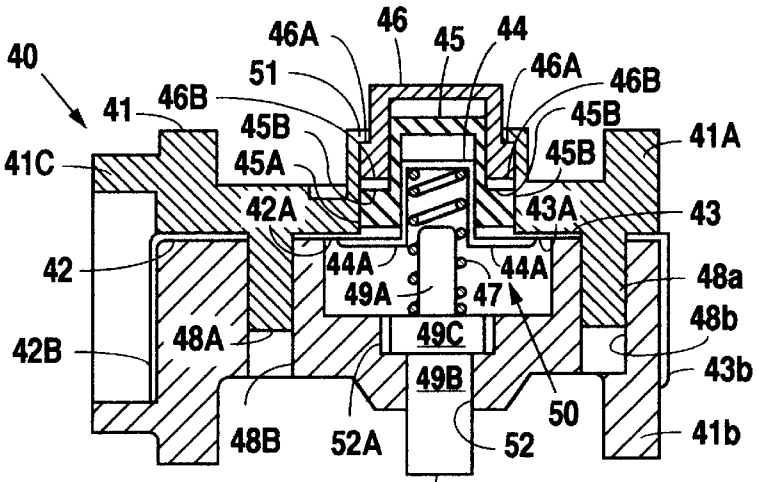
FIG. 2 is an enlarged cross-sectional side view of the switch of FIG. 1.

Referring firstly to FIGS. 1 and 2 of the drawings, there is shown a flashlight 10 embodying the invention, which flashlight 10 comprises a generally cylindrical aluminium barrel 11 having open front and rear ends 12 and 13, a head assembly 20 covering the barrel front end 12, a tail plug 30 closing the barrel rear end 13, and an internal on/off switch 40 adjacent the head assembly 20. The barrel 11, itself being electrically conductive, defines a compartment for holding two battery cells 14.

The head assembly 20 has a tubular aluminium body 21 which has a front end 22 fitted with a circular lens 23 and a rear end 24 through which the barrel front end 12 enters and engages with the body 21 by means of screw threads. The body 21 supports a cup reflector 26 co-axially behind the lens 23 and enclosing a light bulb 27 which enters, from behind, the reflector 26 for providing a forward light beam. The bulb 27 has side and end terminals 27A and 27B and is located at the barrel front end 12 by means of a screw-in cap 28. The cap 28 has a central aperture 28A holding the bulb 27 and a conducting strip 28B which brings the side terminal 27A into electrical connection with the barrel front end 12. The end terminal 27B is accessible from within the barrel front end 12.

The tail plug 30 has a conductive aluminium body 31 which is screwed partially into the barrel rear end 13 and is provided with a conductive compression coil spring 32 for electrically connecting the negative terminal of the battery cells 14 to the barrel rear end 13 via the body 31.

The switch 40 has a body 41, front and rear fixed contact strips 42 and 43, a contact cap 44 for short-circuiting the contact strips 42 and 43, and inner and outer switching caps 45 and 46 for moving the contact cap 44 against the action of a compression coil spring 47. The body 41 has an outermost shape which is generally cylindrical along the axis of the barrel 11 and has an outer cross-sectional size marginally smaller than the inner cross-sectional size of the barrel 11. The body 41 is formed by upper and lower parts 41A and 41B which are engaged together by means of upper posts 48A engaging into respective lower holes 48B.

The switch body 41 defines a central chamber 50, from which the contact strips 42 and 43 extend, along the interface between the body parts 41A and 41B, in opposite directions out of the body 41. The contact strips 42 and 43 have aligned inner ends 42A and 43A accessible from inside the chamber 50 and respective outer ends 42B and 43B folded to lie against corresponding end walls of the body 41 to provide two switch terminals. On the front end wall, the outer end 42B of the front contact strip 42 is surrounded by an integral collar 41C of the body 41.

The chamber 50 has an integral upstanding collar 51 holding co-axially from below the outer switching cap 46 which in turn receives, as a rotational sliding fit, co-axially from below the inner switching cap 45. The contact cap 44 has a peripheral flange 44A and is loosely fitted co-axially inside the inner switching cap 45 in such a position that the flange 44A overlaps from below with the inner ends 42A and 43A of the contact strips 42 and 43 on opposite sides. The spring 47 acts co-axially between the contact cap 44 above and a post 49 below. Under the action of the spring 47, the contact cap 44 is urged upwards to have its flange 44A in contact with the inner ends 42A and 43A of the contact strips 42 and 43, thereby electrically inter-connecting the contact strips 42 and 43 and resulting in a closed condition (as shown) of the switch 40.

The post 49 has upper and lower ends 49A and 49B and an enlarged middle section 49C. The chamber 50 has a bottom hole 52 through the body lower part 41B. The post lower end 49B extends through the hole 52 for protruding out of the body 41, with the post middle section 49C retained inside an enlarged upper end 52A of the hole 52. The post 49 is resiliently biassed downwards by the spring 47 which urges the post middle section 49C against the bottom of the chamber 50 and pushes the post lower end 49B out of the body 41 to an extent slightly beyond the lowermost part of the body 41 or projecting slightly out of the outer cross-section of the body 41.

Figure 3:
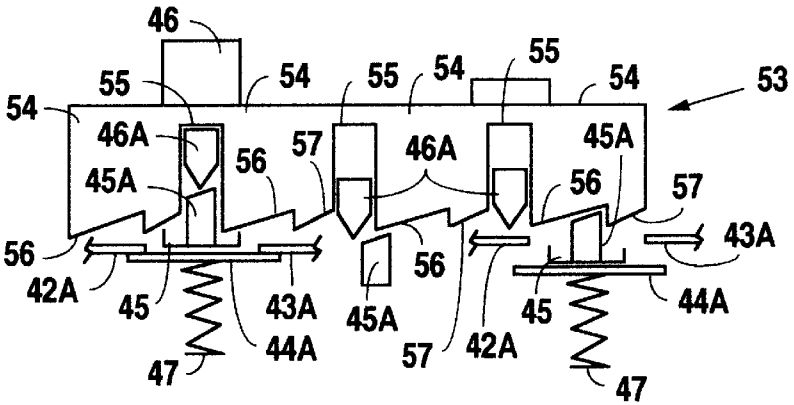
FIG. 3 shows a development of a switching arrangement around an internal periphery of the switch of FIG. 1, in different switching conditions.

Referring now to FIG. 3 of the drawings, the internal surface of the collar 51 has a profile 53 which is divided into four equal quadrants 54 separated by respective vertical slots 55 having open bottom ends. Each quadrant 54 has a bottom edge in the shape of two asymmetrical triangular teeth 56 and 57. Each switching cap 45/46 has four equi-angularly spaced side projections 45A/46A, together forming four pairs. The switching caps 45 and 46 also have respective triangularly toothed peripheries 45B and 46B which are complementarily shaped and, upon mating close together, render each pair of projections 45A and 46A slightly offset horizontally from each other.

In the closed condition of the switch 40, each pair of projections 45A and 46A of the switching caps 45 and 46 are vertically aligned with each other and loosely fit inside the respective slot 55 (see the left slot 55), with the toothed peripheries 45B and 46B not mating close together.

Upon momentary pressing, the outer switching cap 46 moves both the inner switching cap 45 and the contact cap 44 downwards (from the previous position), against the action of the spring 47. When the projections 45A are moved sufficiently down to be clear of the open bottom ends of the respective slots 55, they are free to be offset angularly from the respective projections 46A still staying inside the slots 55. The offset is caused by the toothed peripheries 45B and 46B mating close together, upon a slight rotation of the inner switching cap 45 relative to the outer switching cap 46, under the action of the spring 47.

Such an offset rotation causes the projections 45A to ride, from below, round the adjacent teeth 56 of the respective collar profile quadrants 54 (as shown with respect to the middle slot 55). Upon subsequent release of the outer switching cap 46 and under the continual action of the spring 47, the inner switching cap 45 continues to rotate until each projection 45A reaches and is caught by the junction between the respective pair of teeth 56 and 57 (as shown with respect to the right slot 55) . As a result, the inner switching cap 45 is retained at a position below the previous position, whereby the contact cap 44 is held down away from the inner ends 42A and 43A of the contact strips 42 and 43, resulting in an open condition of the switch 40.

Under this condition, the inner and outer switching caps 45 and 46 are in a relative orientation in which their toothed peripheries 45B and 46B become not mating close together. This imparts, under the action of the spring 47, a similar tendency of offset relative rotation of the inner switching cap 45 from the outer switching cap 46 when the inner switching cap 45 becomes free to rotate next time.

Upon next momentary pressing, the outer switching cap 46 moves the inner switching cap 45 downwards against the action of the spring 47. By reason of the aforesaid offset tendency, the inner switching cap 45 rotates slightly to have its projections 45A riding, from below, round the adjacent teeth 57 of the respective profile quadrants 54. Under the action of the spring 47, the inner switching cap 45 continues to rotate until its projections 45A fall upwards back into the next respective slots 55. As a consequence, the switch 40 returns to the closed condition.

The barrel 11 is formed with, through its front wall, a circular opening 60 and, on the inner side of its rear wall, an aligned detent in the form of a circular recess (or hole) 61. For installation, the switch 40 is firstly inserted sideways into the barrel 11 through the barrel front end 12 (or alternatively through the barrel rear end 13), while the outer switching cap 46 and the post 49 are pressed inwards to fit inside. The switch 40 is then slid along the barrel axis further inwards until the outer switching cap 46 projects out through the opening 60 and the post 49 snaps and engages with the recess 61. The post 49 serves to automatically hold the switch 40 in position. A rubber cap 62 is finally used to cover the outer switching cap 46, said cap 62 having a flanged rim 62A which is squeezed into the barrel 11 through the opening 60 around the outer switching cap 46.

The front terminal 42B of the switch 40 is electrically connected to the end terminal 27B of the light bulb 27, through indirect physical contact, by means of a conductive compression coil spring 25 which is located by the collar 41C of the switch body 41. The switch rear terminal 43B is electrically connected, through direct physical contact, to the positive terminal of the battery cells 14.

The snap-fit co-operation between the post 49 of the switch 40 and the detent/recess 61 of the barrel 11 facilitates the installation of the switch 40 inside the barrel 11. It is envisaged that the outer switching cap 46 itself may be used (in the absence and instead of the post 49) to snapfit with the opening 60 (then equivalent to the recess 61) for fixing the switch 40 in position.

The invention has been given by way of example only, and various other modifications of and/or alterations to the described embodiment may be made by persons skilled in the art without departing from the scope of the invention as specified in the appended claims.

What is claimed is:

1. A flashlight comprising a barrel for containing a battery cell, said barrel having opposite ends, a lateral opening and an internal detent opposite said opening, head and tail pieces provided at respective barrel ends, a light bulb enclosed by said head piece, and an electrical press switch having a switching member and a switch part resiliently biassed outwards in opposite directions by a common spring and provided inside said barrel at a position between and for switching on and off electrical connection between said light bulb and said battery cell, said switching member and switch part being arranged to engage automatically with opening and detent respectively in a double snap-fit manner when said switch is moved into said barrel through one barrel end to hold said switch in a first position.

2. A flashlight as claimed in claim 1, wherein said switch has a body which has an outer cross-sectional size marginally smaller than an inner cross sectional size of said barrel, and said switch part projects slightly out of said outer cross-section of said switch body.

3. A flashlight as claimed in claim 1, wherein said switch part is elongate and is resiliently biassed longitudinally outwards by said spring.

4. A flashlight as claimed in claim 1, wherein said detent is in the form of a hole or recess.

5. A flashlight as claimed in claim 1, wherein said switch has two terminals on opposite sides for electrical connection, through physical contact with or without a conductive spring, with said light bulb and said battery cell, respectively.

6. A flashlight as claimed in claim 1, wherein said switch has two fixed contacts for electrical connection with said light bulb and said battery cell, respectively, and includes a moving contact movable into or out of electrical contact with said fixed contacts.

7. A flashlight as claimed in claim 2, wherein the switching part is elongated and is resiliently biassed longitudinally outwards by a spring.

8. A flashlight as claimed in claim 2, wherein the detent is in the form of a hole or recess.

* * * * *